US006564462B1

(12) United States Patent
Henry

(10) Patent No.: US 6,564,462 B1
(45) Date of Patent: May 20, 2003

(54) PRECISION ADJUSTING MULTIPLE PIN BOW SIGHT

(75) Inventor: Donald J Henry, New Albany, PA (US)

(73) Assignee: HTM Precision Machining, Inc., New Albany, PA (US)

( * ) Notice: Subject to any disclaimer, the term of this patent is extended or adjusted under 35 U.S.C. 154(b) by 0 days.

(21) Appl. No.: 09/518,199

(22) Filed: Mar. 3, 2000

Related U.S. Application Data

(60) Provisional application No. 60/125,624, filed on Mar. 22, 1999.

(51) Int. Cl.[7] ..... F41G 1/00; F41B 5/00

(52) U.S. Cl. ..... 33/265; 124/87

(58) Field of Search ..... 33/265; 124/24.1, 124/87

(56) References Cited

U.S. PATENT DOCUMENTS 3,854,217 A * 12/1974 Killian ..... 33/265
4,499,218 A * 2/1985 Lyakhevich et al. ..... 524/79
4,669,196 A * 6/1987 Kersey ..... 33/265
4,715,126 A * 12/1987 Holt ..... 33/265
4,819,611 A * 4/1989 Sappington ..... 124/87
4,846,141 A * 7/1989 Johnson ..... 124/87
4,910,874 A * 3/1990 Busch ..... 33/265
5,228,204 A * 7/1993 Khoshnood ..... 33/265
5,231,765 A * 8/1993 Sherman ..... 33/265
5,384,966 A * 1/1995 Gibbs ..... 33/265
5,425,177 A * 6/1995 Pacenti ..... 33/265
5,442,861 A * 8/1995 Lorocco ..... 33/265
5,517,979 A * 5/1996 Clossen ..... 124/86
5,560,113 A * 10/1996 Simo et al. ..... 33/265
5,644,849 A * 7/1997 Slates ..... 33/265
5,676,122 A * 10/1997 Wiseby et al. ..... 124/87
5,685,081 A * 11/1997 Winegar ..... 33/265
6,000,141 A * 12/1999 Afshari ..... 33/265
6,199,286 B1 * 3/2001 Reed, Jr. et al. ..... 33/265

* cited by examiner

*Primary Examiner*—Randy W. Gibson
(74) *Attorney, Agent, or Firm*—Rothwell, Figg, Ernst & Manbeck

(57) ABSTRACT

A hunting or three-dimensional bow sight apparatus, including four illuminated sight pins positioned in their own individual housings. Each individual sight pin and it's housing is precisionally adjusted by a threaded drive-screw system. The sight pins and their individual housings are assembled and protected in a sight pin window bracket.

22 Claims, 6 Drawing Sheets

SECTION D-D

SECTION C-C

SECTION A-A (Top Housing Blocks)

SECTION B-B (Bottom Housing Blocks)

PRECISION ADJUSTING MULTIPLE PIN BOW SIGHT

This application claims the benefits of Provisional Patent Application Ser. No. 60/125,624, filed Mar. 22, 1999.

FIELD OF INVENTION

This invention relates to an archery bow sight, specifically to an improved adjusting sight system for bow sights.

BACKGROUND DISCUSSION OF PRIOR ART

The Archer typically uses multiple pin sights whether engaged in hunting, competition shooting or recreational shooting. The use of a bow sight improves the accuracy of their aim. Presently available multiple pin sights are difficult to adjust with precision. When the pin sight is positioned and locked, the design of the mount does not ensure that the pin will remain in the desired position. U.S. Pat. Nos. 4,494,313 5,384,966, 4,884,347 and 4,984,437 disclose types of bow pin sights.

Furthermore, some bow sight light systems provide an inadequate amount of light for multiple pin sights. U.S. Pat. Nos. 5,653,217 and 4,400,887 disclose light systems.

Other objects and features of the invention will become apparent as the description proceeds, especially when taken in conjunction with the accompanying drawings illustrating the embodiment of the invention.

BACKGROUND—CROSS REFERENCE TO RELATED APPLICATION

OBJECTS AND ADVANTAGES

Accordingly, several objects and advantages of the present invention are:

(a) to provide a bow sight whose sight pin screw-driven mechanism is easily adjusted;

(b) to provide a bow sight whose multiple sight pins are adjusted with precision;

(c) to provide a bow sight whose multiple sight pins will move only when adjusted by the precision drive-screw system;

(d) to provide a bow sight which, once each sight pin is adjusted by the drive-screw systems, the drive-screw can be locked into position by a set screw; and (e) to provide a bow sight whose multiple sight pins are illuminated by an ample amount of light.

DRAWING FIGURES

Figure 1:
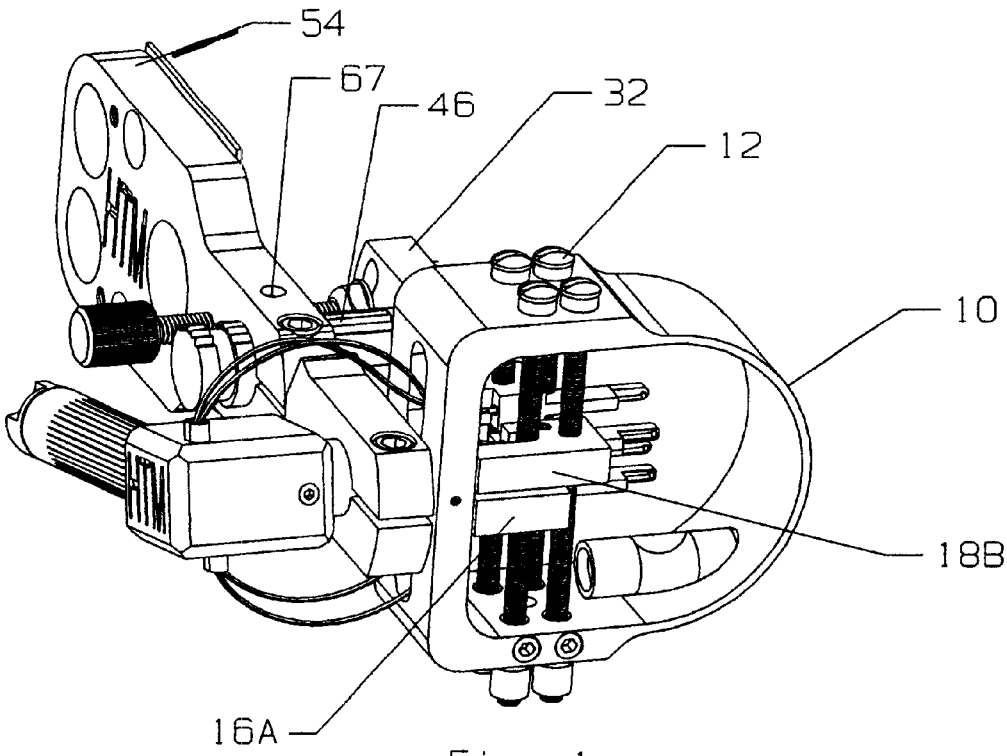
FIG. 1 shows a three dimensional front and side view of the bow sight.

| REFERENCE NUMERALS IN DRAWINGS: | | QUANTITY |
|---|---|---|
| 10 | Sight Pin Window Bracket | (1) |
| 12 | Precision Adjusting Screws | (4) |
| 14 | Nylon Adjusting Screw Bushings | (8) |
| 16 | Sight Pin Housing A | (2) |
| 18 | Sight Pin Housing B | (2) |
| 20 | Bow Sight Level | (1) |
| 22 | Nylon Adjusting Screw Nuts | (4) |
| 24 | 8–32 Set Screws | (4) |
| 26 | Tru Glow ® Pin Sights | (4) |
| 28 | Sight Pin Light Box | (1) |
| 30 | 8–32 × ¾" Allen Head Locking Screw | (1) |
| 32 | Major Adjusting Off-Set Bracket | (1) |
| 34 | Windage Adjusting Screw | (1) |
| 36 | Windage Friction Washers | (2) |
| 38 | Windage Screw Lock Nut | (1) |
| 40 | Windage Adjusting Knob | (1) |
| 42 | Set Screw for Windage Adjusting Knob | (1) |
| 44 | MAG LITE ® Solitaire ® | (1) |
| 46 | Major Adjusting Off-Set Windage Rod | (1) |
| 48 | Sight Pin Window Bracket Extension Rod | (1) |
| 50 | Roll Pin | (1) |
| 52 | Roll Pin | (1) |
| 54 | Mounting Base | (1) |
| 56 | 8–32 × 1" Allen Head Locking Screw | (1) |
| 58 | Set Screws for Light Box | (2) |
| 60 | Rubber Tubing | (2) |
| 62 | Delrin Spacer for Light Box | (1) |
| 64 | Rubber Pad | (1) |
| 66 | Set Screws for Sight Pin Housing Blocks | (1) |
| 67 | Locating Pointed Set Screw | (1) |

STATIC DESCRIPTION OF FIGURES

Figure 2:
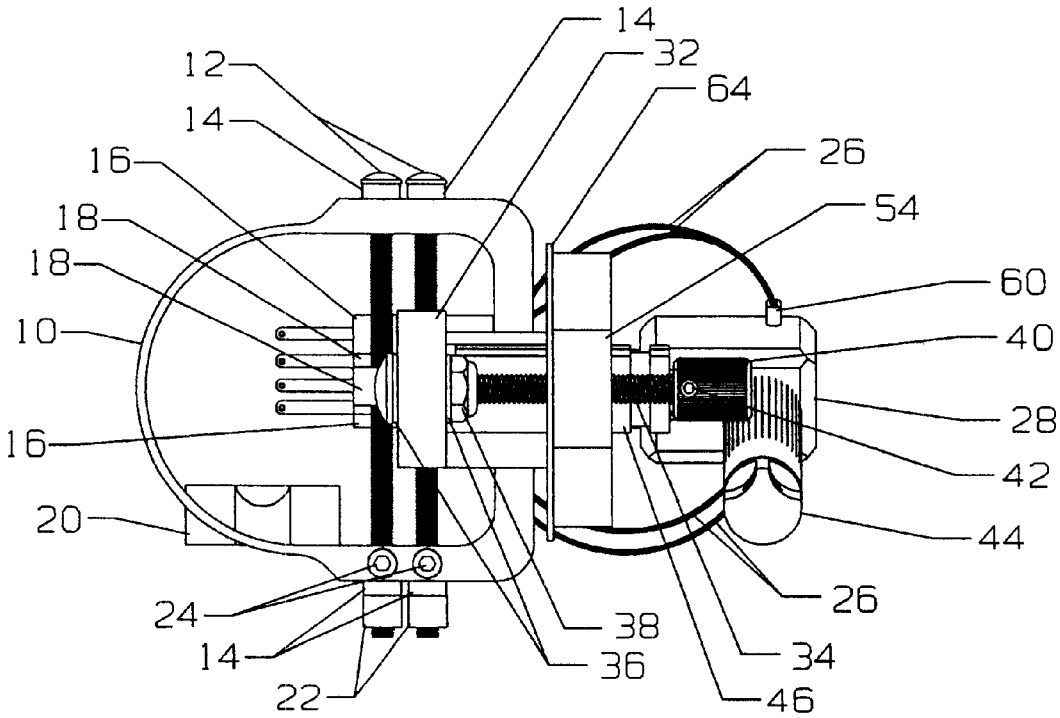
FIG. 2 shows a rear view of the bow sight.
Figure 3:
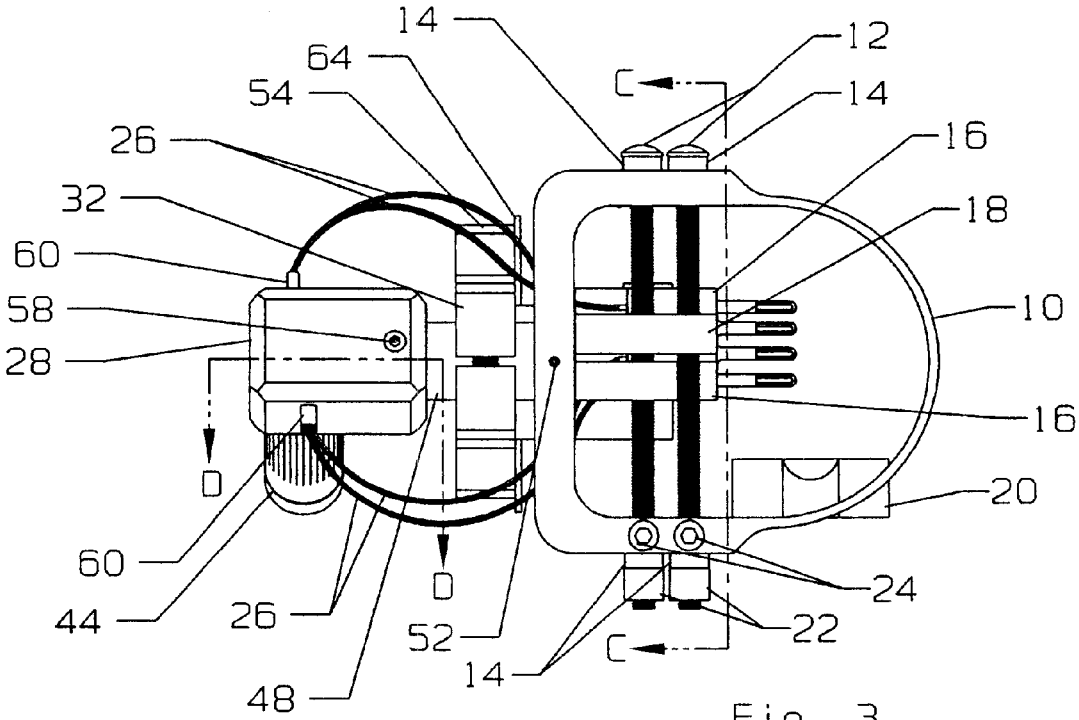
FIG. 3 shows a front view of the bow sight.
Figure 4:
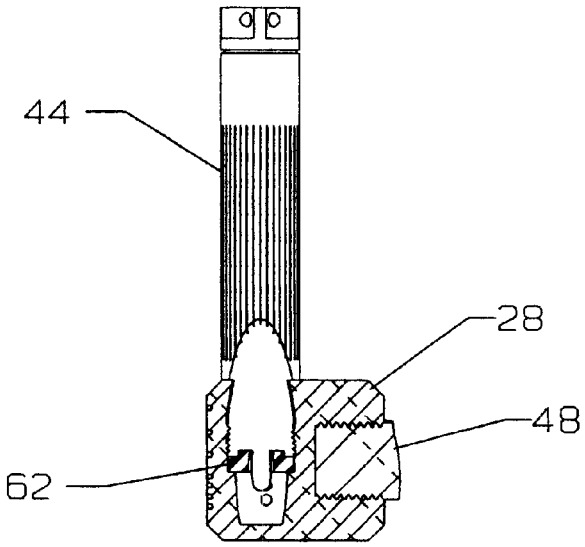
FIG. 4 shows a sectional view of the bow sight.
Figure 6:
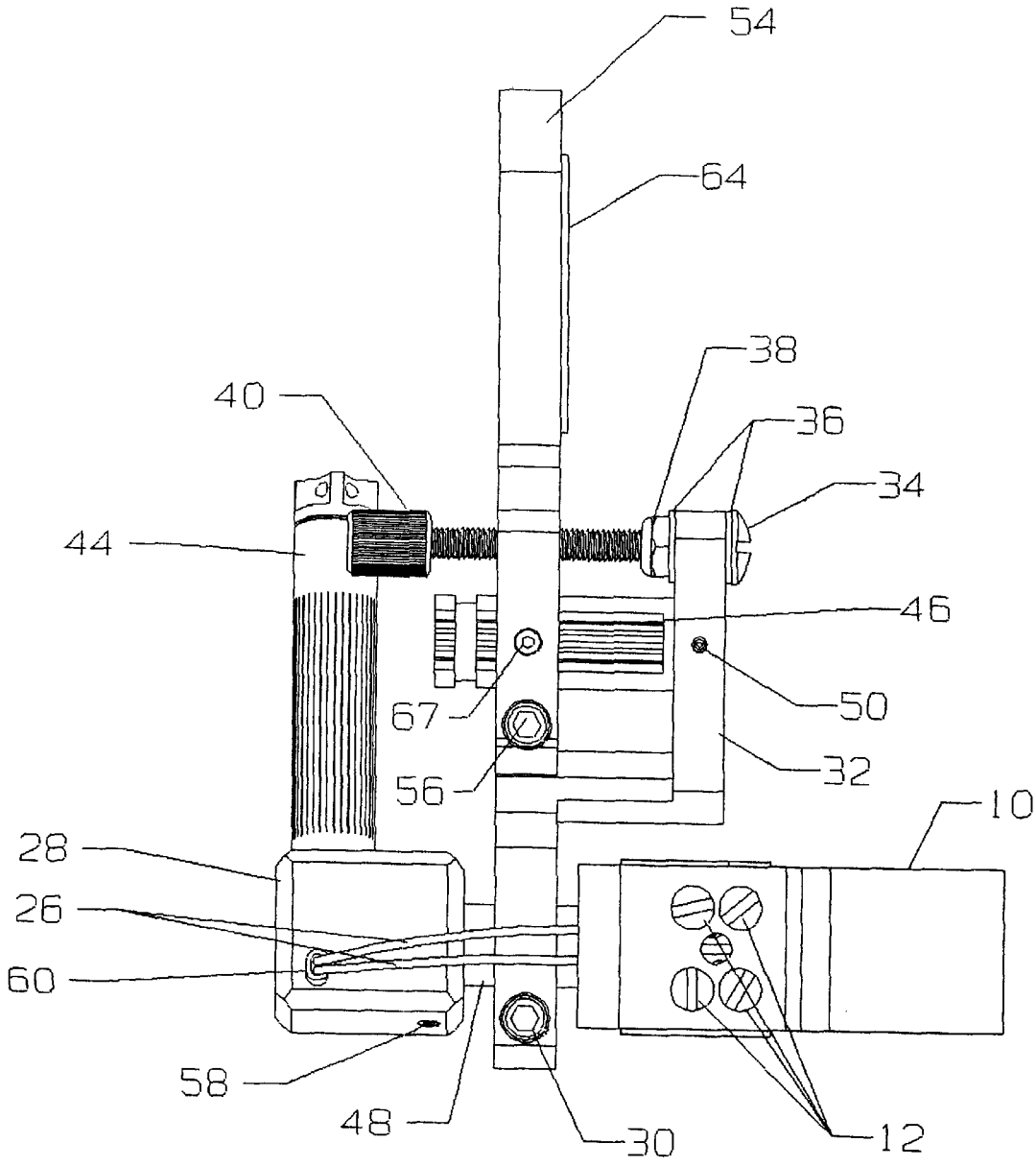
FIG. 6 shows a top view of the bow sight.
Figure 8:
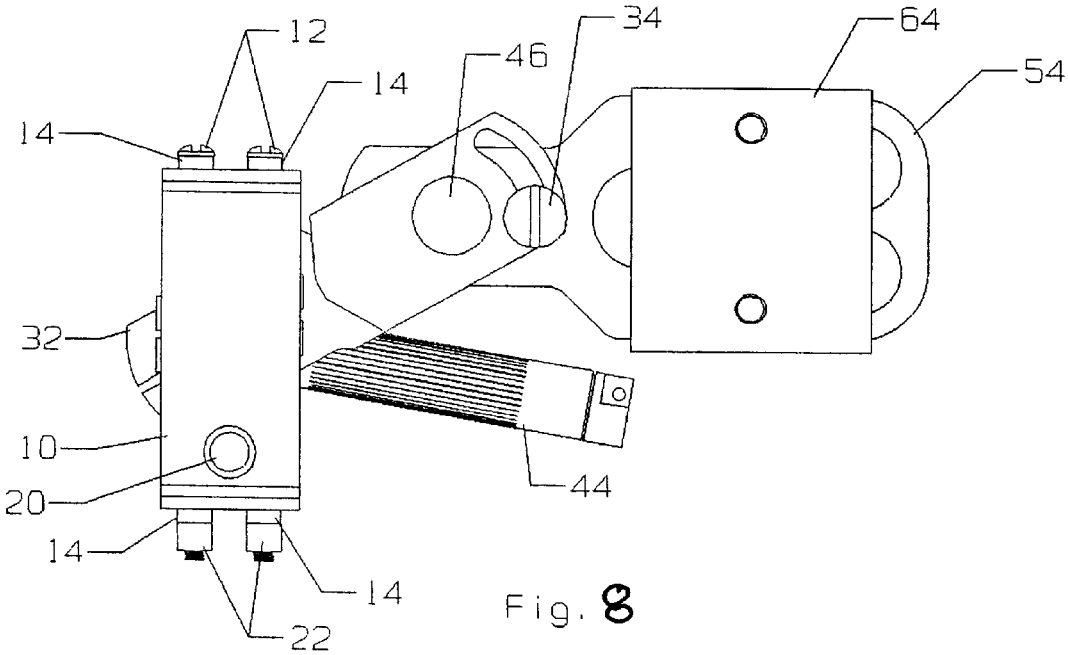
FIG. 8 shows a side view with sight pin window bracket adjusted downward.

The Sight Pin Window Bracket 10 (FIG. 1) houses the Precision Adjusting Screws 12 (FIG. 1) and Sight Pin Housing Blocks A 16 (FIG. 1) and Sight Pin Housing Blocks B 18 (FIG. 1). Connected to the Sight Pin Window Bracket 10 is the Sight Pin Window Bracket Extension Rod 48 (FIG. 3) The Sight Pin Window Bracket Extension Rod 48 (FIG. 3) passes through the Major Adjusting Off-Set Bracket 32 (FIGS. 1 & 6). The Sight Pin Window Bracket Extension Rod 48 (FIGS. 3 & 6) connects to the Sight Pin Light Box 28 (FIG. 3). The Tru Glo® Pin Sights 26 (FIG. 3) are housed in the Sight Pin Housing Blocks A 16 (FIG. 1) and the Sight Pin Housing Blocks B 18 (FIG. 1) and connect to the Sight Pin Light Box 28 (FIG. 3). The MAG-LITE® Solitaire® 44 (FIG. 4) screws into the Sight Pin Light Box 28 (FIG. 4). The Major Adjusting Off-Set Windage Rod 46 (FIGS. 1 & 6) is connected to the Major Adjusting Off-Set Bracket 32 (FIGS. 1 & 8). The Major Adjusting Off-Set Box Windage Rod 46 (FIGS. 1 & 6) passes through the Mounting Base 54 (FIG. 1 & 6). The Windage Adjusting Screw 34 (FIG. 2) passes through the Major Adjusting Off-Set Bracket 32 (FIGS. 2 & 6) and the Mounting Base 54 (FIGS. 1 & 6). The Windage Adjusting Knob 40 (FIG. 2) is secured to the end of the Windage Adjusting Screw 34 (FIG. 2). The Mounting Base 54 (FIGS. 1 & 6) connects the present invention to the bow.

Figure 9:
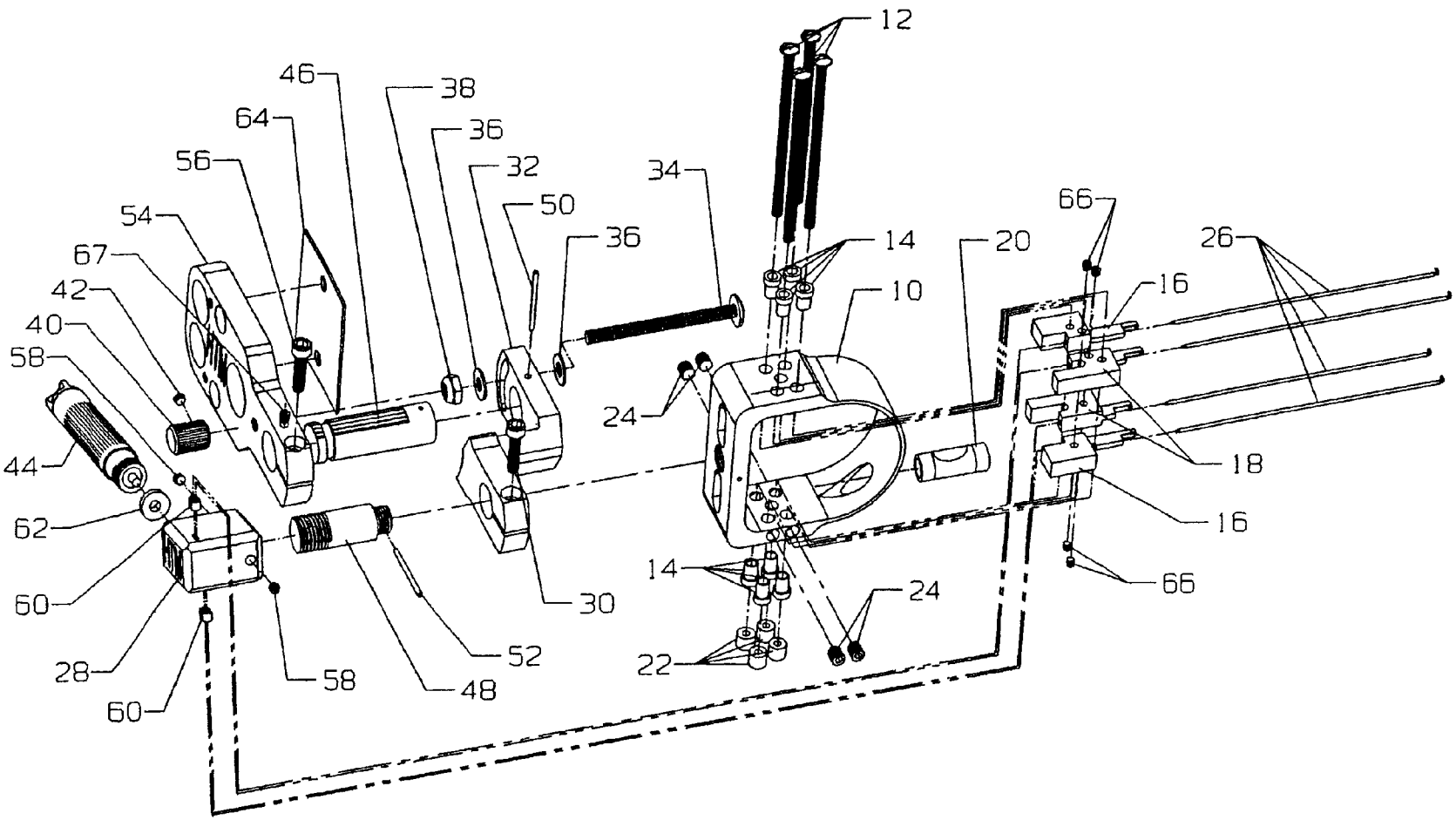
FIG. 9 shows an assembly and parts view of the bow sight.

The Off-set Bracket 32 (FIG. 9) slides over the rod 48 (FIG. 9). The Light Box 28 (FIG. 9) screws onto the end of the extension rod 48 (FIG. 9) The set screws for the Light Box 58 (FIG. 9) screw into the light box 28. The Pin Sights 26 pass through the Rubber Tubing 60 (FIG. 9 and plug into the Light Box 28. The MAG-LITE® Solitaire® (FIG. 9) passes through the spacer for the Light Box 62 (FIG. 9) and is threaded into the light box 28 (FIG. 9).

The Rod 46 (FIG. 9) slides through the Mounting Base 54 (FIG. 9) The Adjusting Screw 34 screws through the base 54. The Windage Adjusting Knob 40 (FIG. 9) screws onto the end of the screw 34. The Set Screw for the Windage Adjusting Knob connects to the knob 40. The Locking Screw 56 (FIG. 9) screws into the base 54 (FIG. 9). The Rubber Pad 64 (FIG. 9) attaches to the base 54 (FIG. 9).

OPERATION OF INVENTION

Figure 5A:
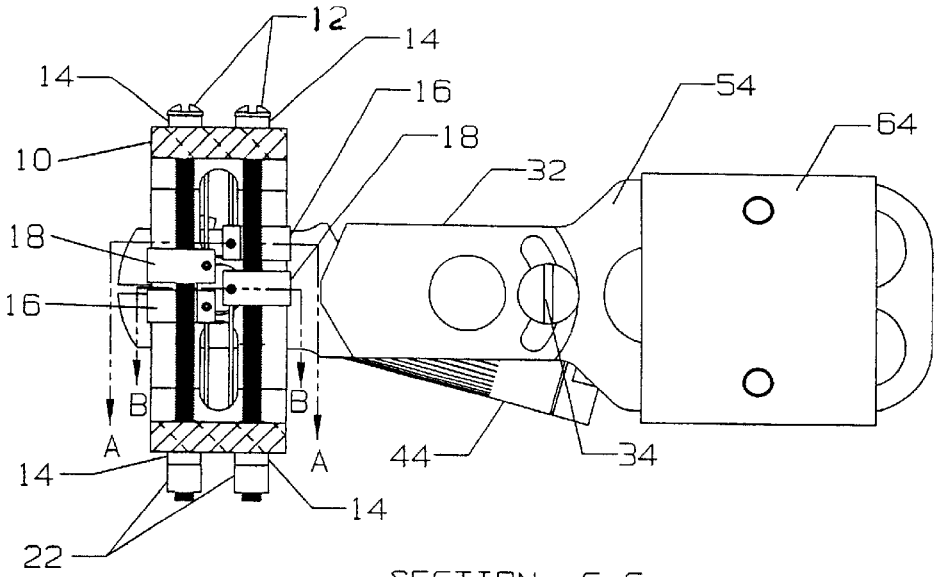
FIG. 5A shows a side sectional view of the bow sight.
Figure 5B:
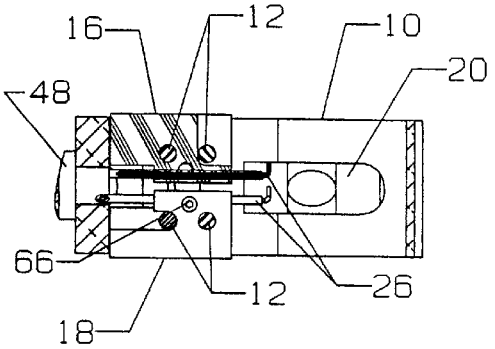
FIG. 5B shows a top sectional view of the bow sight.
Figure 5C:
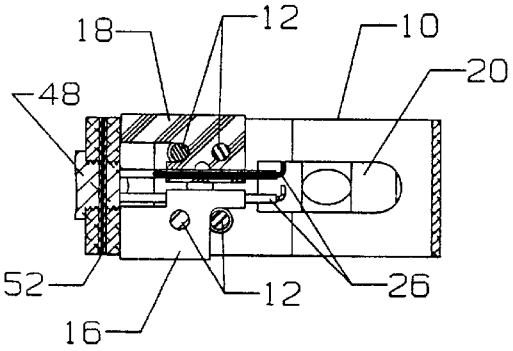
FIG. 5C shows a top sectional view of the bow sight.

The aluminum Sight Pin Window Bracket 10 (FIG. 1) houses, protects and supports the Sight Pin Drive System. Permanently attached by two part apoxy glue, is the Bow Sight Level 20 (FIG. 9) the aluminum Sight Pin Window Bracket Extension Rod 48 (FIG. 3) is threaded and roll pinned 52 (FIG. 9) to the back end of the bracket 10 (FIG. 9). The purpose of the rod 48 (FIG. 3) is to provide additional vertical windage adjustment. The rod 48 (FIG. 3) passes through the Major Adjusting Off-Set Bracket 32 (FIG. 9). The rod 48 (FIG. 9) allows you to level the bracket 10 (FIG. 7) when the Major Adjusting Off-Set Bracket 32 (FIG. 7) is in the upward position (FIG. 7) or downward position (FIG. 8). After passing through the bracket 32 (FIG. 9) the threaded rod end 48 (FIG. 4) screws into the Sight Pin Light Box 28 (FIG. 4). Pressed into the bracket 10 (FIG. 5A) are four nylon bushings at the top and bottom 14 (Fig 5A). The nylon bushings 14 (FIG. 5A) protect and cushion the bracket 10 and screws 12 (FIG. 5A) The nylon bushings 14 eliminate noise caused by vibration. The four stainless steel 6–32×3 inches full threaded round head slotted screws 12 (FIG. 5A pass through the bushing 14 (FIG. 5A) bracket 10 (FIG. 5A) and thread through the Sight Pin Housings A16 and B18 (FIG. 5A) continuing through bracket 10 and bushings 14 and secured by the nylon adjusting screw nuts 22 (FIG. 5A). Also, the screws 12, while passing through the bracket 10 and screwing through the housings 16 and 18, support and lock the housings into position (FIGS. 5B & 5C). The purpose of the adjusting screws 12 (FIG. 5A) that are threaded through housings 16 and 18 is to adjust with precision upward or downward and to maintain permanent adjustment position. After the screws are precisionally adjusted to the desired position, they are locked into permanent position by four steel 8–32×3/16" allen head set screws 24 (FIG. 2). The housings 16 and 18 (FIG. 5A) are supported and driven by the screws 12 (FIG. 5A) and supported at the one end by bracket 10 (FIGS. 5B & 5C). The housings 16 and 18 are made of nylon material to eliminate noise caused by vibration.

Housings 16 and 18 (FIGS. 5B & 5C) hold into position the Tru Glo® Pin sights 26 (FIGS. 5B & 5C). The four pins 26 are locked into position by four steel 4–40×1/8" set screws 66 (FIGS. 9 & 5B). The set screws 66 (FIG. 9) can be accessed for adjustment through the top and bottom center hole located on bracket 10 (FIG. 9).

The aluminum Sight Pin Window Bracket Extension Rod 48 (FIG. 3) passes through the bracket 32 (FIG. 3). The bracket 32 (FIG. 3) is made of aluminum. Where the rod 48 (FIG. 3) passes through the bracket 32 (FIG. 3) there is a 8–32×3/4" steel allen head locking screw 30 (FIG. 9). The screw 30 (FIG. 9) locks the bracket 32 (FIG. 9) to the rod 48 (FIG. 3). Attached to the bracket 32 (FIG. 9) is the aluminum Major Adjustment Off-Set Windage Rod 46 (FIG. 6). The rod 46 (FIG. 6) is pressed and steel roll pinned 50 (FIG. 9) into the bracket 32 (FIG. 9). The rod 46 (FIG. 9) allows for micro vertical windage adjustment by passing through the Mounting Base 54 (FIG. 9). Rod 46 (FIG. 9) has five "v" grooves running parallel to it's top. the grooves locate and hold the five different upward or downward adjustment positions.

Figure 7:
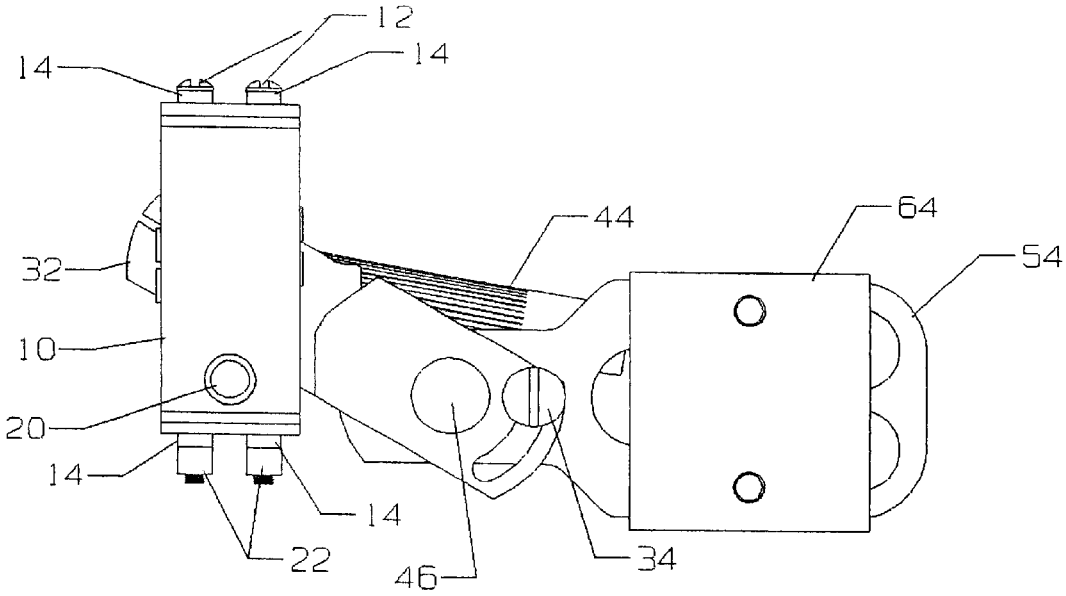
FIG. 7 shows a side view with sight pin window bracket adjusted upward.

The purpose of the Major Adjusting Off-set bracket 32 (FIG. 6) is to off-set the Sight Pin Window Bracket 10 (FIG. 6). The bracket 32 (FIG. 6) puts the brackets 10 (FIG. 6) into the desired position and allows for in and out windage adjustment. Another major adjustment is the upward adjustment (FIG. 7) and downward major adjustment (FIG. 8). The major adjustments upward and downward are done by pivoting the "v" grooved rod 46 (FIG. 7) that passes through bracket 54 (FIG. 7). Positioned in the Mounting Base 54 (FIG. 9) is a pointed locating set screw 67 (FIG. 9). Once adjusted downward into the "v" groove, the set screw 67 will hold the rod 46 (FIG. 9) into positon. Also, the rotation is done by the windage adjustment screw 34 (FIG. 7) that passes through the slot of the bracket 32 (FIGS. 7 & 8) and slides the bracket 32 upward or downward on the screw 34 (FIGS. 7 & 8).

The Windage Adjustment Screw 34 (FIG. 6) is a stainless steel 10–32×1-1/4" round head slotted screw that is fully threaded. The screw 34 (FIG. 6) passes through the nylon Windage Friction Washer 36 (FIG. 6) and through the slot of the bracket 32 (FIG. 6) and continues through another washer 36 (FIG. 6) and is secured into position to the bracket 32 by a steel Windage Screw Lock Nut 38 (FIG. 6). The screw 34 (FIG. 6) is threaded through the bracket 54 (FIG. 6). At the end of the screw 34 (FIG. 6) is an aluminum Windage Adjusting Knob 40 (FIG. 6). The knob 40 (FIG. 6) is screwed onto the end of the screw 34 (FIG. 6) and locked into position by a steel 6–32×1/8" set screw 42 (FIG. 2). This screw 34 (FIG. 6) micro adjusts the bracket 32 (FIG. 6) inward and outward. By turning the screw 34 clockwise it pushes the off set bracket 32 outward and slides the rod 46 through the mounting base 54 (FIG. 6). By turning the screw 34 counterclockwise, it pulls the bracket 32 inward toward the base 54 (FIG. 6). Once windage adjustment is made, bracket 32 is locked into positon by tightening the 8–32×1" allen head locking screw 56 (FIG. 6). This screw 56 clamps base 54 to rod 46 (FIG. 6) and secures the windage adjustment.

The Aluminum Mounting Base 54 (FIG. 6) attaches and secures the sight to the bow. Also, it allows for windage adjustment. A rubber pad 64 (FIGS. 6, 7 & 8) is located between base 54 and the bow when securing the sight to the bow. The purpose of the rubber pad 64 is to quiet the bow by absorbing vibration.

The Tru Glo® Pin sights 26 (FIG. 9) pass through the housings 16 and 18 (FIGS. 5A, 5B & 9) and the back slots of the bracket 10 (FIG. 9) and continue passing through the rubber tubing 60 (FIG. 9) and plugs into the four holes located in the Sight Pin Light Box 28 (FIG. 9) The two Rubber Tubes 60 (FIG. 9) hold into position two Tru Glob Pin sights 26 (FIG. 9) located a the top and bottom of the Sight Pin Light Box 28 (FIG. 6) houses the four Pin Sights 26 (FIG. 6) and the MAG-LITE® Solitaire® (FIGS. 4 & 6). The Light Box 28 (FIG. 6) can be rotated into the desired position and locked by two 6–32×3/16" stainless steel cup point set screws 58 (FIGS. 6 & 9). Secured to the interior light box 28 (FIG. 4) with two part apoxy glue is a delrin spacer 63 (FIG. 4 & 9). The purpose of the spacer 62 (FIG. 4) is to turn the MAG-LITE® Solitaire® 44 on or off. When the light 44 (FIG. 4) is screwed inward the light turns off; when the light 44 is turned outward by a one-half turn, the light is on. The purpose of the light 44 (FIG. 4) is to supply light into the Light Box Chamber 28 (FIG. 4). The fiber optic Tru Glo® pin sights 26 (FIG. 4) also plug into the same light chamber and transfer the light to the aiming end of the fiber optic Tru Glo® Pin Sights 26 (FIG. 2).

SUMMARY

An illuminated multiple pin bow sight system that is easy to adjust with precison. The sight is movable only when adjusted by the individual drive screws and permanently locked once adjusted.

Ramifications

While I have illustrated and described a preferred embodiment of my invention, it is understood that this is capable of modification. Therefore, I do not wish to be limited to the precise details set forth, but desire to avail myself of such changes and alterations as fall within the purview of the following claims.

What I claim as my invention is:

1. An adjustable sight pin system for use with a bow, comprising:

a sight pin bracket;

a plurality of sight pin housings housed in said sight pin bracket and adapted to hold a sight pin; and a plurality of drive screws, each of said plurality of drive screws extending through one of said plurality of said sight pin housings and operable to move said sight pin housing in a substantially vertical direction.

2. The adjustable sight pin system of claim 1, further comprising a set screw operable to hold at least one of said plurality of drive screws in place.

3. The adjustable sight pin system of claim 1, further comprising:

a mounting bracket;

an adjusting bracket coupled to said mounting bracket for rotational movement relative to said mounting bracket; wherein said sight pin bracket is mounted to said adjusting bracket; and said adjusting bracket is configured to offset said sight pin bracket towards the bow.

4. The adjustable sight pin system of claim 3, further comprising an adjusting rod coupled to said mounting bracket and said adjusting bracket to facilitate rotation of said adjusting bracket relative to said mounting bracket.

5. The adjustable sight pin system of claim 4, wherein said adjusting rod is fixedly attached to said adjusting bracket and said adjusting rod is rotatably coupled to said mounting bracket.

6. The adjustable sight pin system of claim 4, further including a windage adjusting member operable to adjust the lateral position of said adjusting bracket relative to said mounting bracket.

7. The adjustable sight pin system of claim 5, wherein:

said adjusting rod includes a plurality of detents, and said mounting bracket includes a positioning screw adapted to engage with at least one of said plurality of detents to prevent rotational movement of said adjusting rod.

8. The adjustable sight pin system of claim 1, wherein at least one of said plurality of sight pin blocks abuts said sight pin bracket.

9. The adjustable sight pin system of claim 1, wherein at least one of said plurality of drive screws contacts a side of one of said plurality of sight pin blocks.

10. The adjustable sight pin system of claim 1, further including:

a mounting bracket;

an adjusting bracket coupled to said mounting bracket for rotational and lateral movement relative to said mounting bracket, and wherein said sight pin bracket is mounted to said adjusting bracket.

11. The adjustable sighting mechanism of claim 10, further comprising a plurality of set screws, each of set screws operable to prevent rotational movement of one of said plurality of drive screws.

12. An adjustable sighting mechanism for use with a bow including a bow string, the bow defining a bow plane, comprising:

a mounting bracket for attaching to the bow;

an offset bracket coupled to said mounting bracket;

a sight pin bracket mounted to said offset bracket;

a plurality of sight pin housings housed in said sight pin bracket; and wherein said offset bracket is configured to offset said sight pin bracket in a direction perpendicular to the bow plane and away from the bow string.

13. The adjustable sighting mechanism of claim 12, wherein said offset bracket includes three substantially straight segments.

14. The adjustable sighting mechanism of claim 12, wherein said offset bracket includes a first end coupled to said sight pin bracket, a second end coupled to said mounting bracket, and a center portion connecting said first end and said second end.

15. The adjustable sighting mechanism of claim 14, wherein said center portion is substantially perpendicular to said first end or said second end.

16. The adjustable sighting mechanism of claim 12, further including:

a plurality of drive screws, each of said plurality of drive screws extending through one of said plurality of said sight pin housings and operable to move said sight pin housing in a substantially vertical direction.

17. An adjustable sight pin system for use with a bow including a bow string, the bow defining a bow plane, comprising:

a sight pin bracket;

a plurality of sight pin housings housed in said sight pin bracket and adapted to hold a sight pin;

an adjusting means coupled to at least one of said plurality of sight pin housings and operable to move said sight pin housing in a substantially vertical direction;

an offset means configured to offset said sight pin bracket in a direction perpendicular to the bow plane and away from the bow string; and said sight pin bracket being mounted to said offset means.

18. The adjustable sight pin system of claim 17, further comprising a set screw operable to prevent said adjusting means from moving said at least one sight pin housing.

19. The adjustable sight pin system of claim 17, further comprising:

a mounting means; and said offset means coupled to said mounting means for rotational movement relative to said mounting means.

20. The adjustable sight pin system of claim 19, further comprising an rotating means coupled to said mounting means and said offset means for facilitating rotation of said offset means relative to said mounting means.

21. The adjustable sight pin system of claim 20, wherein said rotating means is fixedly coupled to said offset means and said rotating means is rotatably coupled to said mounting bracket.

22. The adjustable sight pin system of claim 20, further including a lateral adjusting means for adjusting the lateral position of said offset means relative to said mounting means.

* * * * *